US007930850B1

(12) United States Patent
Beaman

(10) Patent No.: US 7,930,850 B1
(45) Date of Patent: Apr. 26, 2011

(54) SPARE GUN BARREL HANGING ASSEMBLY

(76) Inventor: Robert Beaman, Princeton, WV (US)

( * ) Notice: Subject to any disclaimer, the term of this patent is extended or adjusted under 35 U.S.C. 154(b) by 249 days.

(21) Appl. No.: 12/218,195

(22) Filed: Jul. 11, 2008

Related U.S. Application Data

(60) Provisional application No. 60/959,229, filed on Jul. 13, 2007.

(51) Int. Cl.
*F41C 27/00* (2006.01)

(52) U.S. Cl. ..... 42/85; 42/90

(58) Field of Classification Search ..... 42/70.11, 42/77, 85, 90, 95, 106; 248/117.5, 155.2, 248/341, 432, 689, 690, 692; 224/150, 198, 224/272

See application file for complete search history.

(56) References Cited

U.S. PATENT DOCUMENTS 223,926 A * 1/1880 Kinney ..... 42/72
225,062 A * 3/1880 Kinney ..... 42/72
2,937,666 A * 5/1960 Maisch ..... 138/89
3,556,454 A * 1/1971 Huver ..... 248/317
3,620,493 A * 11/1971 Huver ..... 248/692
3,749,348 A 7/1973 Bartlett
3,802,612 A * 4/1974 Smith ..... 224/569
4,018,339 A * 4/1977 Pritz ..... 211/8
4,364,499 A 12/1982 McCue
4,560,134 A 12/1985 Klin
4,569,144 A * 2/1986 Thurber ..... 42/70.11
4,726,137 A * 2/1988 Zurek et al. ..... 42/95
5,022,536 A 6/1991 Pierson
5,263,592 A 11/1993 Dinger, Jr.
5,438,787 A 8/1995 McCmaster
5,772,295 A 6/1998 Sundmark
6,561,477 B1 * 5/2003 Prive ..... 248/339
6,834,454 B2 * 12/2004 Klein ..... 42/70.11
7,124,530 B1 * 10/2006 Clark ..... 42/94
2006/0179701 A1 * 8/2006 Mossberg et al. ..... 42/77

* cited by examiner

*Primary Examiner* — Bret Hayes

(57) ABSTRACT

A spare gun barrel hanging assembly preferably includes an elongated post that has a curvilinear top end, and first and second anchor platforms statically coupled to such a post, which extend orthogonally away therefrom. The assembly may further include a mechanism for removably securing the existing spare gun barrel to a bottom surface of the second anchor platform while the first anchor platform remains spaced thereabove, and a hanger pin removably inserted into the first anchor platform.

16 Claims, 6 Drawing Sheets

SPARE GUN BARREL HANGING ASSEMBLY

CROSS REFERENCE TO RELATED APPLICATIONS

This application claims the benefit of U.S. Provisional Application No. 60/959,229, filed Jul. 13, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to gun barrel holders and, more particularly, to an adaptable spare gun barrel hanging assembly for safely holding a variety of spare gun barrels at a substantially stable position.

2. Prior Art

In this day and age there is, unfortunately, the ever increasing need for an individual to store a loaded handgun at his home so as to deter and prevent home burglaries and other such crimes where the confines of a person's home is breached by an individual or individuals having criminal intentions. Thus, there is a rapidly growing need for a container which enables the safe storage of a loaded handgun at a residence and yet does not allow for access thereto by a child or any other person not authorized to enter the same. In addition, many guns today include spare barrels that should advantageously be stored with the appropriate gun. Such barrels are very expensive and are often scratched or otherwise damaged when stored at the bottom of a gun cabinet. It would therefore be advantageous to develop a means for storing a gun barrel within a gun cabinet where it will be protected from storage damage while also staying out of the hands of children. While the prior art includes and discloses a number of containers which are lockable and intended for use with a loaded handgun, none of these devices provides an effective means for storing and protecting expensive gun barrels.

U.S. Pat. No. 5,438,787 to McMaster discloses a gun storage and rapid removal mount for securely retaining a shotgun or the like against unauthorized removal with the mount providing for rapid removal by authorized persons. It is comprised of a trigger guard cup and a forward lock clamp. The lock clamp engages the barrel and a magazine tube just forward of the shotgun receiver to prevent forward motion of the shotgun in the mount. The trigger guard cup prevents rearward motion. The lock clamp is both lock- and spring-retained. When its lock is released, the gun can be rotated out of the clamp against spring force. The spring also permits reinsertion of the shotgun into position against the spring force. Unfortunately, this prior art example is not designed as a hanging apparatus for storage in various cabinets, closets or cupboards.

U.S. Pat. No. 4,560,134 to Klein discloses a gun rack particularly adapted for mounting a shotgun within the passenger compartment of an automobile, positioned muzzle down alongside the driver's seat. The gun rack includes an elongated frame member supported at its rear by a pair of support legs, which are independently adjustable in length and angle. Each leg is fastened to the floor in a lowered position to establish the muzzle down position of the mounted shotgun. Rotatably adjustable hinges are located at the ends of each leg and the forward end of the frame, together with the adjustability of the legs, enable mounting to the widely varying transmission tunnels and floor contours of different automotive models. The barrel of the shotgun is received in an element carried by the rack in a position above the forward end of the frame, which position is adjustable lengthwise to accommodate different shotgun barrel lengths. The element may take the form of a plug received within the bore of the shotgun, or a partially cylindrically shaped seat receiving the outside diameter of the forward end of the gun barrel. Also, an adjustable position trigger shroud is provided surrounding the trigger region of a shotgun disposed in the rack to prevent accidental discharge. Unfortunately, this prior art example is not designed to store many different types of gun barrels, including barrels of different gauges and calibers.

Accordingly, the present invention is disclosed in order to overcome the above noted shortcomings. The spare gun barrel hanging assembly is convenient and easy to use, lightweight yet durable in design, and designed for safely holding an existing spare gun barrel at a substantially stable position. The assembly is simple to use, inexpensive, and designed for many years of repeated use.

BRIEF SUMMARY OF THE INVENTION

In view of the foregoing background, it is therefore an object of the present invention to provide an assembly for safely holding an existing spare gun barrel at a substantially stable position. These and other objects, features, and advantages of the invention are provided by an adaptable spare gun barrel hanging assembly.

A spare gun barrel hanging assembly preferably includes an elongated post that effectively has a curvilinear top end, and first and second anchor platforms statically coupled to such a post and extending orthogonally away therefrom. Such a second anchor platform may include vertically separated top and bottom surfaces which define a cavity therebetween. The second anchor platform may further include first and second vertically aligned apertures formed in the top and bottom surfaces respectively, and a coupling intermediately disposed between the first and second apertures and rotatably seated within the cavity.

The assembly may further include a mechanism for removably securing the existing spare gun barrel to a bottom surface of the second anchor platform while the first anchor platform advantageously remains spaced thereabove. Such a removably securing mechanism is preferably detachable from the second anchor platform.

In one embodiment, the removably securing mechanism may further include a clevis that has a top edge statically mated to a bottom tip of the primary rod. Such a clevis may be provided with a pair of orifices formed at laterally opposed vertical sides of the clevis. The removably securing mechanism may further include a rectilinear locking pin tethered to a bottom region of the clevis. Such a tethered locking pin is preferably freely removably positioned through the orifices when oriented perpendicular to a longitudinal length of the primary rod. The clevis preferably has an open front face and may include a bulging protrusion that has a curvilinear top surface. Such a bulging protrusion may be statically mated to a bottom surface of the clevis and may span between the vertical sides thereof for receiving an existing hinge portion of the existing spare gun barrel.

In such an embodiment, the removably securing mechanism may further include a rectilinear primary rod removably penetrated through at least one of the first and second apertures. Such a primary rod may conveniently extend downwardly from the second anchor platform, and may further be threadably mated with the coupling and configured in such a manner that the primary rod may be reciprocated along a rectilinear path when the coupling is rotated in a corresponding direction. One skilled in the art understands that the corresponding direction of the coupling is defined along clockwise and counterclockwise directions to bias or reciprocate the primary rod along the rectilinear path. The primary rod is preferably raised and lowered along the rectilinear path, and the rectilinear path may be axially aligned with the apertures and extend through the second anchor platform.

The removably securing mechanism of both embodiments may preferably include a bore effectively formed within the second anchor platform and axially offset from the first and second apertures, and an auxiliary rod removably inserted into the bore. Such an auxiliary rod preferably has a threaded top end and a bottom end directly conjoined to the threaded top end. Such a bottom end may have a smooth outer surface provided with a suitably sized and shaped predetermined diameter for receiving a top end of the existing gun barrel, and the threaded top end is preferably detachably mated with the bore so that the auxiliary rod extends vertically downwardly therefrom.

In another embodiment, the removably securing mechanism may further include an elongated rectilinear strap that has a threaded upper portion and a beveled bottom portion. Such a beveled bottom portion is preferably provided with an axially oriented hole formed therein. The removably securing mechanism may further include an end cap removably engaged with the hole. Such an end cap may be adapted to conveniently maintain an existing ring of the existing gun barrel at a substantially stable position when the end cap is engaged with the hole.

The strap is preferably reciprocated along a rectilinear path when the coupling is rotated in a corresponding direction, and may further be raised and lowered along the rectilinear path. One skilled in the art understands that the corresponding direction of the coupling is defined along clockwise and counterclockwise directions to bias or reciprocate the strap along the rectilinear path. The rectilinear path is preferably axially aligned with the apertures and may extend through the second anchor platform.

In both embodiments, the first and second anchor platforms are preferably vertically aligned and spaced along a rectilinear segment of the post. The spare assembly may further include a hanger pin removably and advantageously inserted into the first anchor platform and preferably extends upwardly therefrom such that the anchor pin is vertically registered subjacent to a distal end of the curvilinear top end of the post.

A preferred method for safely holding an existing spare gun barrel at a substantially stable position may include the chronological steps of: providing an elongated post that has a curvilinear top end; providing and statically coupling first and second anchor platforms to the post by extending the first and second anchor platforms orthogonally away from the post; removably securing the existing spare gun barrel to a bottom surface of the second anchor platform while the first anchor platform remains spaced thereabove; and detaching the existing spare gun barrel from the second anchor platform for use during operating conditions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
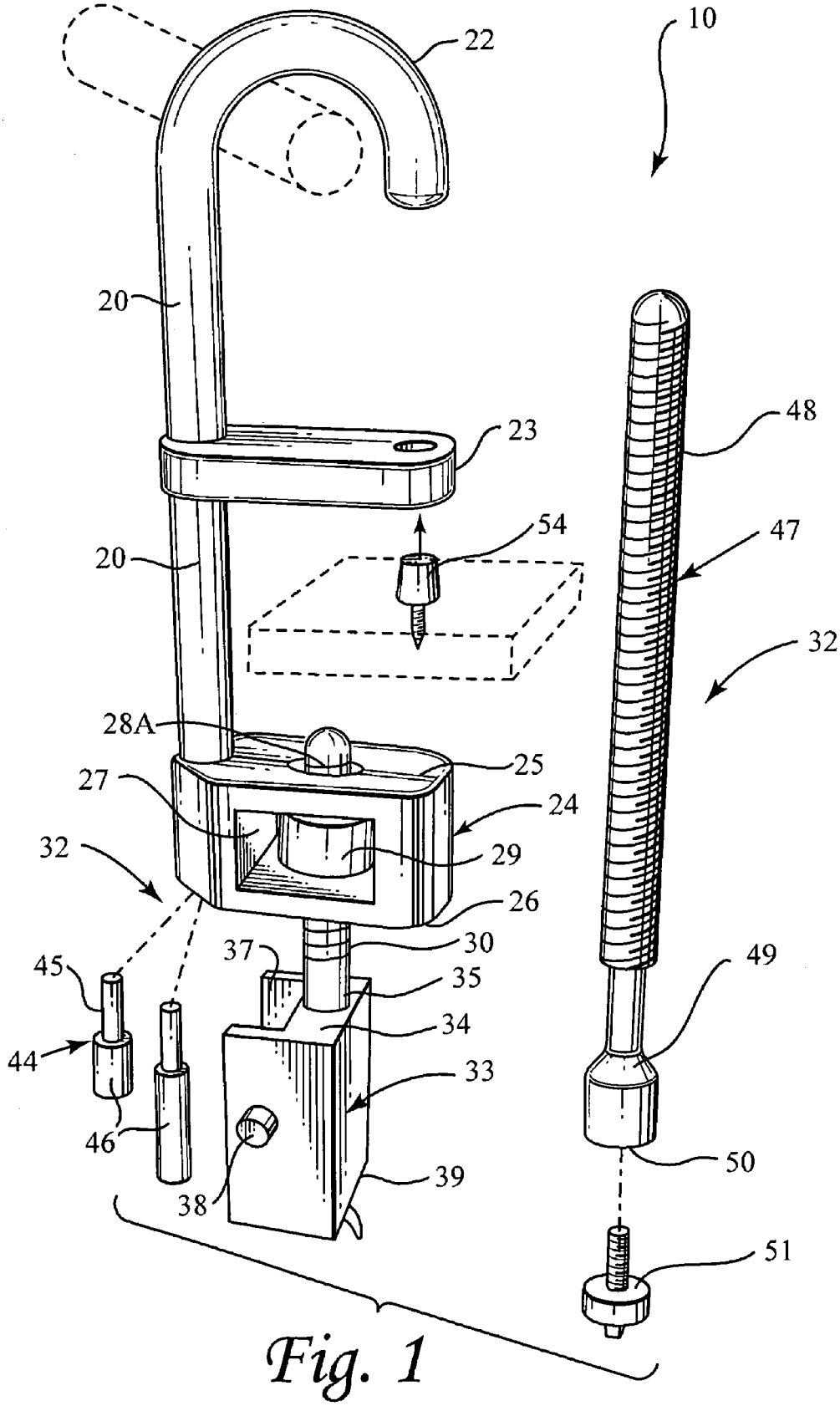
FIG. 1 is a perspective view showing a spare gun barrel hanging assembly, in accordance with the present invention.
Figures 2, 3:
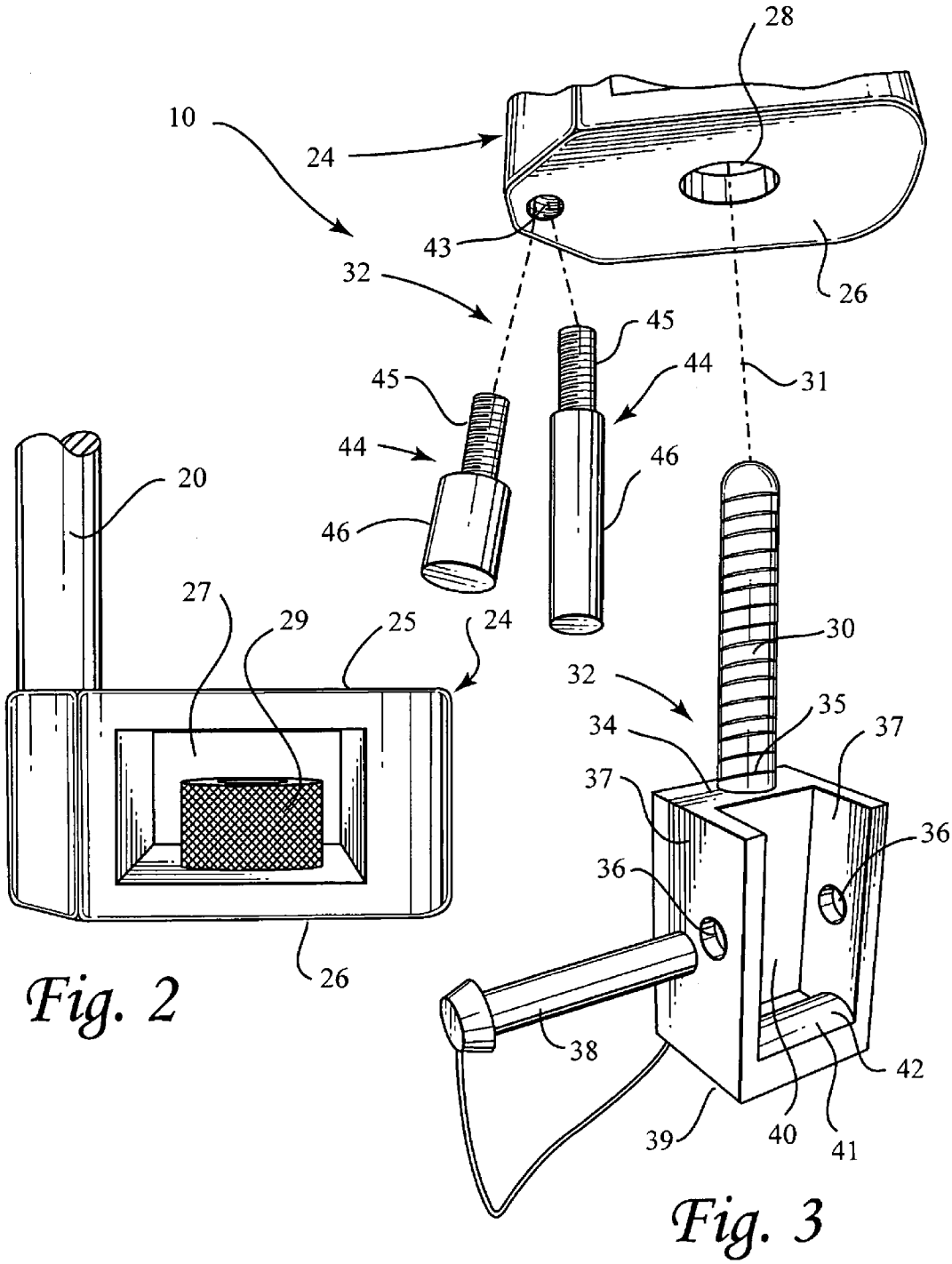
FIG. 2 is a partially enlarged front elevational view showing the second anchor platform.
FIG. 3 is a partially enlarged perspective view showing the mechanism for removably securing an existing spare gun barrel, in accordance with one embodiment of the present invention.
Figure 4:
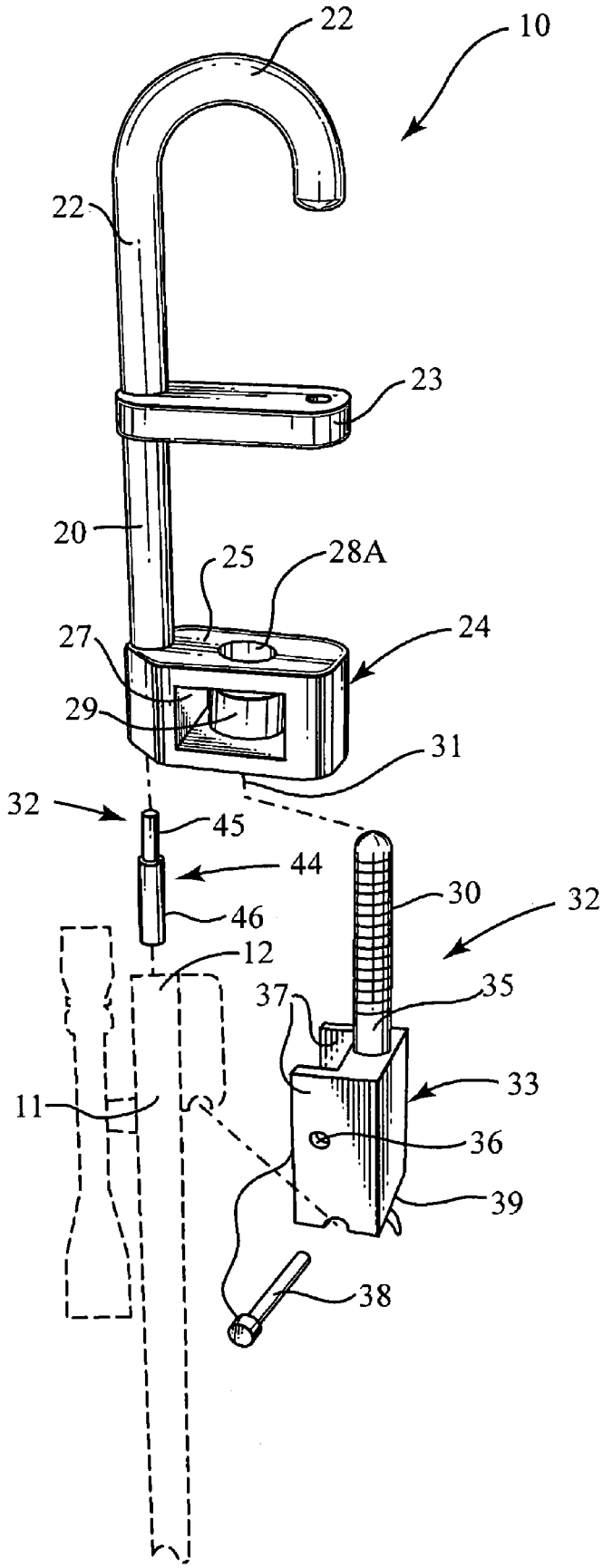
FIG. 4 is a perspective view showing a spare gun barrel hanging assembly in use with the clevis wherein a bottom portion of the spare gun barrel sits on a protrusion of the clevis, in accordance with the embodiment shown in FIG. 3
Figure 5:
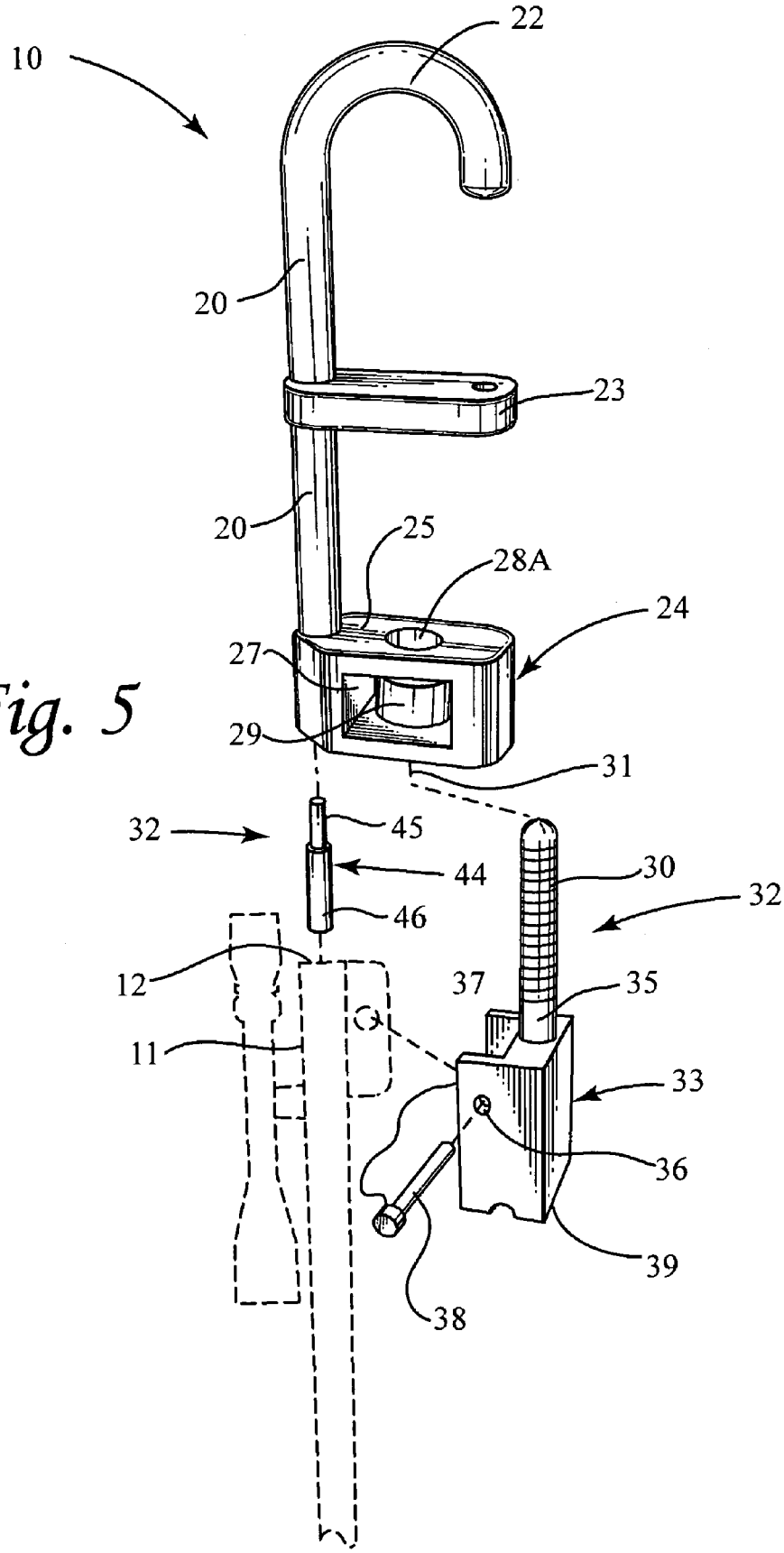
FIG. 5 is a perspective view showing a spare gun barrel hanging assembly in use with the clevis wherein a pin is positioned through an aperture of the spare gun barrel, in accordance with the embodiment shown in FIG. 3.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-7 by the reference numeral 10 and is intended to provide a spare gun barrel hanging assembly. It should be understood that the assembly 10 may be used to store many different types of gun barrels and should not be limited to storing only those types and models of spare gun barrels mentioned herein.

Referring initially to FIGS. 1-7, a spare gun barrel hanging assembly 10 preferably includes an elongated post 20 that has a curvilinear top end 22, and first and second anchor platforms 23, 24 statically coupled to such a post 20 and extending orthogonally away therefrom. Such a second anchor platform 24 may include vertically separated top and bottom surfaces 25, 26 which define a cavity 27 therebetween. The second anchor platform 24 may further include first and second vertically aligned apertures 28A, 28B formed in the top and bottom surfaces 25; 26 respectively, and a coupling 29 intermediately disposed between the first and second apertures 28A, 28B and rotatably seated within the cavity 27.

Referring to FIGS. 1-7, the assembly 10 may further include a mechanism 32 for removably securing the existing spare gun barrel 11 to a bottom surface 26 of the second anchor platform 24 while the first anchor platform 23 remains spaced thereabove. Such a removably securing mechanism 32 is preferably detachable from the second anchor platform 24.

In one embodiment 10, as shown in FIGS. 1-5, the removably securing mechanism 32 may further include a clevis 33 that has a top edge 34 statically mated to a bottom tip 35 of the primary rod 30. Such a clevis 33 may be provided with a pair of orifices 36 formed at laterally opposed vertical sides 37 of the clevis 33. The removably securing mechanism 32 may further include a rectilinear locking pin 38 tethered to a bottom region 39 of the clevis 33. Such a tethered locking pin 38 is preferably freely removably positioned through the orifices 36 when oriented perpendicular to a longitudinal length of the primary rod 30. The clevis 33 preferably has an open front face 40 and may include a bulging protrusion 41 that has a curvilinear top surface 42. Such a bulging protrusion 41 may be statically mated to a bottom surface of the clevis 33 and may span between the vertical sides 37 thereof for receiving an existing hinge portion of the existing spare gun barrel 11.

As shown in the embodiment 10 of FIGS. 1-5, the removably securing mechanism 32 may further include a rectilinear primary rod 30 removably penetrated through at least one of the first and second apertures 28A, 28B. Such a primary rod 30 may extend downwardly from the second anchor platform 24, and may further be threadably mated with the coupling 29 and configured in such a manner that the primary rod 30 may be reciprocated along a rectilinear path 31 when the coupling 29 is rotated in a corresponding direction.

The primary rod 30 is preferably raised and lowered along the rectilinear path 31, and the rectilinear path 31 may be axially aligned with the apertures 28A, 28B and extend through the second anchor platform 24. The combination of such claimed elements provides an unpredictable and unexpected result which is not rendered obvious by one skilled in the art, wherein the assembly may hang by the curvilinear top end 22 from a storage closet or gun cabinet. Thus, the assembly, as well as an extra gun barrel, may be stored using a minimum amount of space.

Referring to FIGS. 1-7, the removably securing mechanism 32 of both embodiments 10, 10' preferably include a bore 43 formed within the second anchor platform 24 and axially offset from the first and second apertures 28A, 28B, and an auxiliary rod 44 removably inserted into the bore 43. Such an auxiliary rod 44 preferably has a threaded top end 45 and a bottom end 46 directly conjoined to the threaded top end 45. Such a bottom end 46 may have a smooth outer surface provided with a suitably sized and shaped predetermined diameter for receiving a top end 12 of the existing gun barrel 11, and the threaded top end 45 is preferably detachably mated with the bore 43 so that the auxiliary rod 44 extends vertically downwardly therefrom. The combination of such claimed elements provides an unpredictable and unexpected result which is not rendered obvious by one skilled in the art, wherein the bulging protrusion 41 and the locking pin 38 of the clevis 33 may secure the spare gun barrel 11 without scratching the surface or damaging the spare gun barrel 11. Additionally, the auxiliary rod 44 may further secure the spare gun barrel 11 by only contacting the interior of the barrel.

Figure 6:
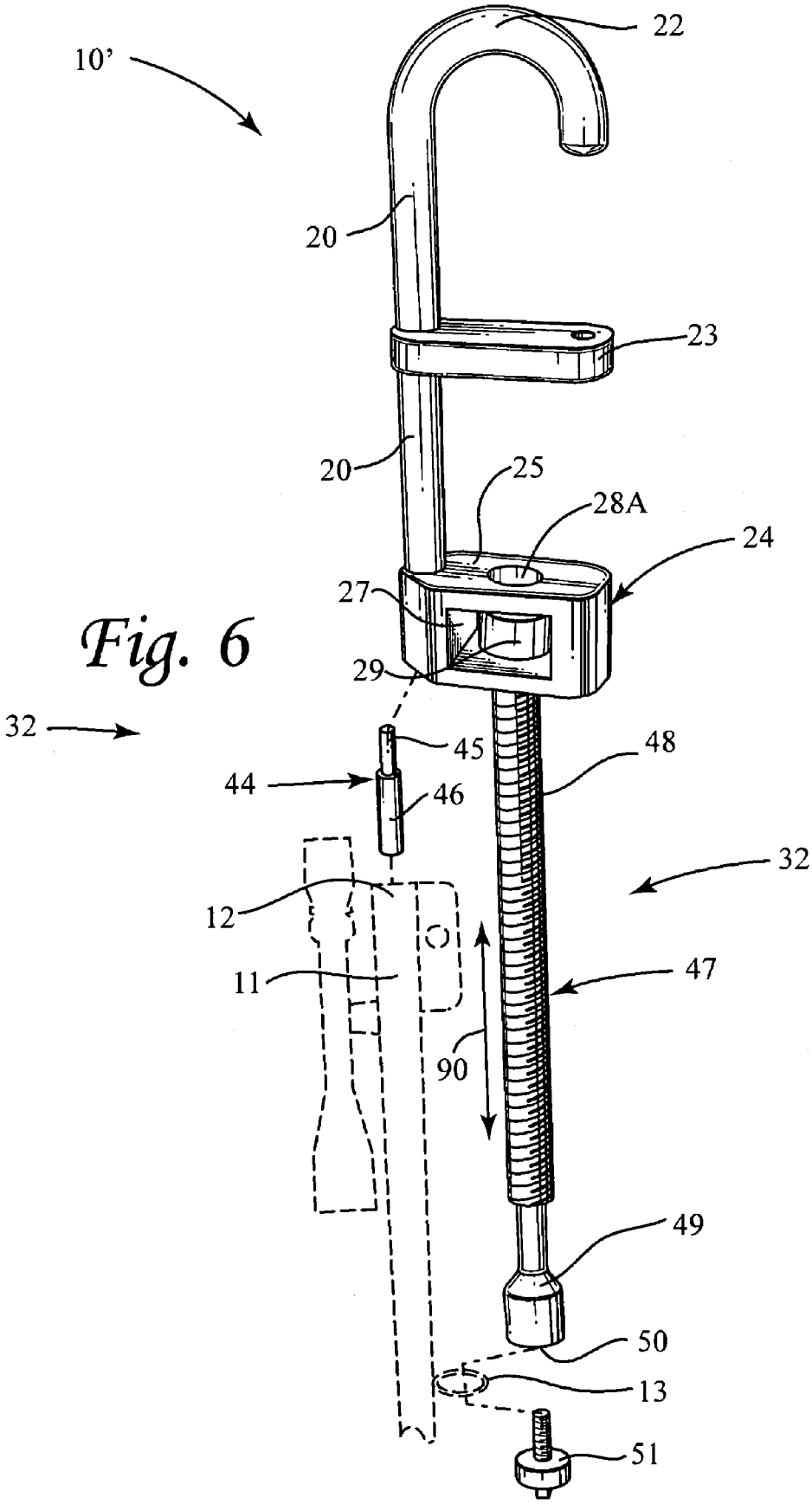
FIGS. 6-7 are perspective views showing a spare gun barrel hanging assembly in use with the strap, in accordance with another embodiment of the present invention.
Figure 7:
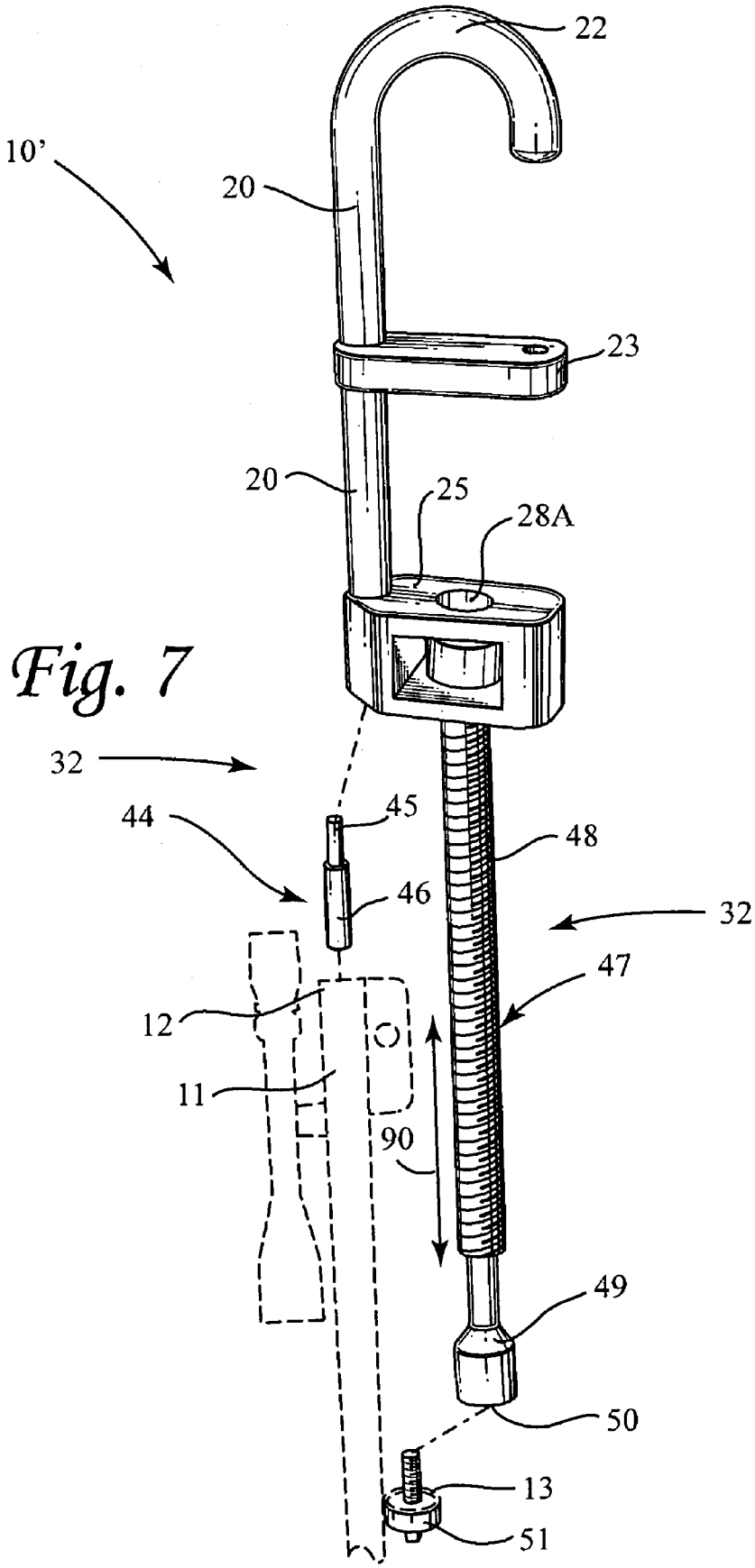

Referring to FIGS. 1, 6, and 7, the removably securing mechanism may 32 of embodiment 10' may further include an elongated rectilinear strap 47 that has a threaded upper portion 48 and a beveled bottom portion 49. Such a beveled bottom portion 49 is preferably provided with an axially oriented hole 50 formed therein. The removably securing mechanism 32 may further include an end cap 51 removably engaged with the hole 50. Such an end cap 51 may be adapted to maintain an existing ring 13 of the existing gun barrel 11 at a substantially stable position when the end cap 51 is engaged with the hole 50.

The strap 47 is preferably reciprocated along a rectilinear path 90 when the coupling 29 is rotated in a corresponding direction and may further be raised and lowered along the rectilinear path. One skilled in the art understands that the corresponding direction of the coupling 29 is defined along clockwise and counter clockwise directions to bias or reciprocate the strap 47 along the rectilinear path 90. The rectilinear path 90 is preferably axially aligned with the apertures 28A, 28B and may extend through the second anchor platform 24.

In both embodiments, 10, 10', the first and second anchor platforms 23, 24 are preferably vertically aligned and spaced along a rectilinear segment of the post 20. The assembly 10, 10' may further include a hanger pin 54 removably inserted into the first anchor platform 23 and preferably extends upwardly therefrom such that the anchor pin 54 is vertically registered subjacent to a distal end of the curvilinear top end 22 of the post 20. The combination of such claimed elements provides an unpredictable and unexpected result which is not rendered obvious by one skilled in the art, wherein the removably securing mechanism 32 may adapt the assembly 10 to be used with different types of gun barrels 11. Thus a user may not be required to purchase multiple embodiments of the assembly 10 for different guns.

In use, a preferred method for safely holding an existing spare gun barrel 11 at a substantially stable position may include the chronological steps of: providing an elongated post 20 that has a curvilinear top end 22; providing and statically coupling first 23 and second 24 anchor platforms to the post by extending the first 23 and second 24 anchor platforms orthogonally away from the post 22; removably securing the existing spare gun barrel 11 to a bottom surface 26 of the second anchor platform 24 while the first anchor platform 23 remains spaced thereabove; and detaching the existing spare gun barrel 11 from the second anchor platform 24 for use during operating conditions.

The present invention, as claimed, provides the unexpected and unpredictable benefit of an assembly that is preferably used to safely hold different gauges and calibers of gun barrels in a gun cabinet. The assembly 10 may be comprised of an elongated post 20 with a curvilinear top end 22. Such a post 20 preferably includes first and second anchor platforms 23, 24, with the second anchor platform 24 having first and second vertically aligned apertures 28A, 28B with a coupling 29 for preferably raising and lowering a strap 47. The second anchor platform 24 may also include another, smaller aperture on the bottom thereof that preferably holds a caliber or gauge.

In use, the assembly 10 is simple and straightforward to use. First, the user chooses a barrel 11 that needs to be stored. Next, the barrel 11 is placed into the appropriate storage chamber of the assembly 10, according to the gauge or caliber of the barrel. After placing the existing barrel 11 into the appropriate chamber of the gun barrel hanging assembly 10, the assembly 10 may be stored in a gun cabinet or other appropriate device by way of the elongated post 20. The gun barrel hanging assembly 10 is designed to store many different types of barrels, including barrels of different gauges and calibers.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A spare gun barrel hanging assembly for safely holding an existing spare gun barrel at a substantially stable position, said spare gun barrel hanging assembly comprising:

an elongated post having a curvilinear top end;

first and second anchor platforms statically coupled to said post and extending orthogonally away therefrom; and means for removably securing the existing spare gun barrel to a bottom surface of said second anchor platform while said first anchor platform remains spaced thereabove;

wherein said second anchor platform comprises:

vertically separated top and bottom surface defined a cavity therebetween;

first and second vertically aligned apertures formed in said top and bottom surfaces respectively; and a coupling intermediately disposed between said first and second apertures and being rotatably seated within said cavity.

2. The spare gun barrel hanging assembly of claim 1, wherein said removably securing means comprises: a rectilinear primary rod removably penetrated through at least one of said first and second apertures;

wherein said primary rod extends downwardly from said second anchor platform.

3. The spare gun barrel hanging assembly of claim 2, wherein said primary rod is threadably mated with said coupling and is configured in such a manner that said primary rod is reciprocated along a rectilinear path when said coupling is rotated in a corresponding direction;

wherein said primary rod is raised and lowered along the rectilinear path, said rectilinear path being axially aligned with said apertures and extending through said second anchor platform.

4. The spare gun barrel hanging assembly of claim 3, wherein said removably securing means further comprises:

a clevis having a top edge statically mated to a bottom tip of said primary rod, said clevis being provided with a pair of orifices formed at laterally opposed vertical sides of said clevis; and a rectilinear locking pin tethered to a bottom region of said clevis, said tethered locking pin being freely removably positioned through said orifices when oriented perpendicular to a longitudinal length of said primary rod;

wherein said clevis has an open front face and includes a bulging protrusion having a curvilinear top surface, said bulging protrusion being statically mated to a bottom surface of said clevis and spanning between said vertical sides thereof for receiving an existing hinge portion of the existing spare gun barrel.

5. The spare gun barrel hanging assembly of claim 1, wherein said removably securing means comprises:

a bore formed within said second anchor platform and being axially offset from said first and second apertures; and an auxiliary rod removably inserted into said bore, said auxiliary rod having a threaded top end and a bottom end directly conjoined to said threaded top end;

wherein said bottom end has a smooth outer surface provided with a suitably sized and shaped predetermined diameter for receiving a top end of the existing gun barrel;

wherein said threaded top end is detachably mated with said bore so that said auxiliary rod extends vertically downwardly therefrom.

6. The spare gun barrel hanging assembly of claim 5, wherein said removably securing means comprises:

an elongated rectilinear strap having a threaded upper portion and a beveled bottom portion, said beveled bottom portion being provided with an axially oriented hole formed therein; and an end cap removably engaged with said hole;

wherein said end cap is adapted to maintain an existing ring of the existing gun barrel at a substantially stable position when said end cap is engaged with said hole;

wherein said strap is reciprocated along a rectilinear path when said coupling is rotated in a corresponding direction;

wherein said strap is raised and lowered along the rectilinear path, said rectilinear path being axially aligned with said apertures and extending through said second anchor platform.

7. The spare gun barrel hanging assembly of claim 1, wherein said first and second anchor platforms are vertically aligned and spaced along a rectilinear segment of said post.

8. The spare gun barrel hanging assembly of claim 1, further comprising:

a hanger pin removably inserted into said first anchor platform and extending upwardly therefrom such that said anchor pin is vertically registered subjacent to a distal end of said curvilinear top end of said post.

9. A spare gun barrel hanging assembly for safely holding an existing spare gun barrel at a substantially stable position, said spare gun barrel hanging assembly comprising:

an elongated post having a curvilinear top end;

first and second anchor platforms statically coupled to said post and extending orthogonally away therefrom; and means for removably securing the existing spare gun barrel to a bottom surface of said second anchor platform while said first anchor platform remains spaced thereabove;

wherein said removably securing means is detachable from said second anchor platform;

wherein said second anchor platform comprises:

vertically separated top and bottom surface defined a cavity therebetween;

first and second vertically aligned apertures formed in said top and bottom surfaces respectively; and a coupling intermediately disposed between said first and second apertures and being rotatably seated within said cavity.

10. The spare gun barrel hanging assembly of claim 9, wherein said removably securing means comprises: a rectilinear primary rod removably penetrated through at least one of said first and second apertures;

wherein said primary rod extends downwardly from said second anchor platform.

11. The spare gun barrel hanging assembly of claim 10, wherein said primary rod is threadably mated with said coupling and is configured in such a manner that said primary rod is reciprocated along a rectilinear path when said coupling is rotated in a corresponding direction;

wherein said primary rod is raised and lowered along the rectilinear path, said rectilinear path being axially aligned with said apertures and extending through said second anchor platform.

12. The spare gun barrel hanging assembly of claim 11, wherein said removably securing means further comprises:

a clevis having a top edge statically mated to a bottom tip of said primary rod, said clevis being provided with a pair of orifices formed at laterally opposed vertical sides of said clevis; and a rectilinear locking pin tethered to a bottom region of said clevis, said tethered locking pin being freely removably positioned through said orifices when oriented perpendicular to a longitudinal length of said primary rod;

wherein said clevis has an open front face and includes a bulging protrusion having a curvilinear top surface, said bulging protrusion being statically mated to a bottom surface of said clevis and spanning between said vertical sides thereof for receiving an existing hinge portion of the existing spare gun barrel.

13. The spare gun barrel hanging assembly of claim 9, wherein said removably securing means comprises:

a bore formed within said second anchor platform and being axially offset from said first and second apertures; and an auxiliary rod removably inserted into said bore, said auxiliary rod having a threaded top end and a bottom end directly conjoined to said threaded top end;

wherein said bottom end has a smooth outer surface provided with a suitably sized and shaped predetermined diameter for receiving a top end of the existing gun barrel;

wherein said threaded top end is detachably mated with said bore so that said auxiliary rod extends vertically downwardly therefrom.

14. The spare gun barrel hanging assembly of claim 9, wherein said removably securing means comprises:

an elongated rectilinear strap having a threaded upper portion and a beveled bottom portion, said beveled bottom portion being provided with an axially oriented hole formed therein; and an end cap removably engaged with said hole;

wherein said end cap is adapted to maintain an existing ring of the existing gun barrel at a substantially stable position when said end cap is engaged with said hole;

wherein said strap is reciprocated along a rectilinear path when said coupling is rotated in a corresponding direction;

wherein said strap is raised and lowered along the rectilinear path, said rectilinear path being axially aligned with said apertures and extending through said second anchor platform.

15. The spare gun barrel hanging assembly of claim 9, wherein said first and second anchor platforms are vertically aligned and spaced along a rectilinear segment of said post.

16. The spare gun barrel hanging assembly of claim 9, further comprising:

a hanger pin removably inserted into said first anchor platform and extending upwardly therefrom such that said anchor pin is vertically registered subjacent to a distal end of said curvilinear top end of said post.

* * * * *